US006079905A

United States Patent [19]

Ruiz et al.

[11] Patent Number: 6,079,905

[45] Date of Patent: Jun. 27, 2000

[54] BRACKET ASSEMBLY FOR LIFTING AND SUPPORTING A FOUNDATION

[75] Inventors: Richard Dean Ruiz, Des Peres; Troy Dean Ruiz, St. Louis; Thomas R. Knecht, Webster Groves; Robert Joseph McCann, O'Fallon; Scott Allen Ruiz, Kirkwood; Stephen E. Schmidt, Hillsboro; Curtis Alan Gentile, Ballwin, all of Mo.

[73] Assignee: Richard D. Ruiz, LLC, St. Louis, Mo.

[21] Appl. No.: 09/211,753

[22] Filed: Dec. 15, 1998

[51] Int. Cl.[7] ..... E02D 27/48

[52] U.S. Cl. ..... 405/230; 405/232; 405/229

[58] Field of Search ..... 405/230, 229, 405/303, 231, 232; 52/157, 161

[56] References Cited

U.S. PATENT DOCUMENTS

| | | | |
|---|---|---|---|
| 4,634,319 | 1/1987 | May . | |
| 5,116,355 | 5/1992 | Freeman, III . | |
| 5,120,163 | 6/1992 | Holdeman et al. . | |
| 5,139,368 | 8/1992 | Hamilton et al. . | |
| 5,154,539 | 10/1992 | McCown et al. | 405/230 |
| 5,171,107 | 12/1992 | Hamilton et al. . | |
| 5,217,325 | 6/1993 | Freeman, III . | |
| 5,246,311 | 9/1993 | West et al. . | |
| 5,269,630 | 12/1993 | Bolin et al. | 405/230 |
| 5,336,021 | 8/1994 | Freeman, III . | |
| 5,433,556 | 7/1995 | Freeman, III . | |
| 5,711,504 | 1/1998 | Cusimano . | |
| 5,722,798 | 3/1998 | Gregory . | |
| 5,800,094 | 9/1998 | Jones . | |

*Primary Examiner*—Dennis L. Taylor
*Attorney, Agent, or Firm*—Greensfelder, Hemker & Gale, P.C.

[57] ABSTRACT

An improvement for a bracket assembly of the type used in lifting and supporting a foundation upon a pier is provided. An adjustable brace member is provided in the bracket assembly to decrease the available front to back space within the bracket to prevent movement of the retained pier within the bracket so as to reduce bending moment on the pier. The brace member comprises a slot disposed within a top of the bracket, which receives one or more locking tabs to retain the pier. Threaded bolts which enable the bracket to engage and be supported on the pier are received in elongated holes on the bracket to allow positioning of the lifting and support hardware directly over the pier. The modified bracket assembly allows for the replacement of any size or configuration of pier.

16 Claims, 7 Drawing Sheets

BRACKET ASSEMBLY FOR LIFTING AND SUPPORTING A FOUNDATION

BACKGROUND OF THE INVENTION

This invention relates to piering systems for shoring up building foundations and provides an improvement to the bracket assembly used in connection with such systems. Such bracket assemblies are used to transfer the weight, or load, being carried from a foundation or footing to a pier, pile or deep foundation. Its most common application is in "cradling" the footing or foundation wall of a structure, then transferring that load to a pile or pier that bears on bedrock or other load bearing strata.

Various piering systems have been employed in the past to support failed, shallow footings. Piers made of concrete, reinforced concrete, timber, steel pipe, steel tubing, and solid steel bar stock with helixes have been used in the past to support failed or failing footings, with varying degrees of success. An area of concern when using any of these piers on existing foundations is in adequately transferring the load of the foundation to the pier. Placing the pier concentrically below the existing foundation is a common solution to the problem, but sometimes becomes impractical and dangerous due to overhead limitations when working immediately below an existing foundation. Typically, an excessive excavation is required, or pier sections will be too short. Short pier sections are not only cumbersome and time consuming from an installation standpoint, but result in a pier that is of questionable flexural rigidity.

Thus, there exists a need for a bracket assembly to adequately transfer the foundation load to a pier located adjacent to the foundation. A major design consideration for such a bracket is in reducing the space it takes up between the pier and the foundation. The distance between the pier and the foundation must be kept to an absolute minimum, or a bending moment (eccentric load) of considerable magnitude will be induced into the top of the pier. This moment not only stresses the bracket unnecessarily, but also imparts a moment on the pier at a point where its lateral support from the soil is at a minimum.

There exist a number of prior art bracket assembly designs used in transferring the foundation load to a particular style of pier. See, for example, Holdeman et al, U.S. Pat. No. 5,120,163, Hamilton et al, U.S. Pat. No. 5,171,107, and West et al, U.S. Pat. No. 5,246,311. These brackets are quite adequate for their purpose, but they are each limited to a specific style or size of pier. None are adjustable to accommodate different sizes and styles of piers. Because of the potentially different conditions that may be present at a foundation supporting job, such as soil stability and depth attainable, a number of different styles and sizes of piers may be required. It can, however, become quite burdensome to have to carry a complete inventory of different bracket styles to the job site. It would be desirable to have one type of bracket which is adaptable for all types and sizes of piers.

SUMMARY OF THE INVENTION

According to the present invention, there is provided an improvement to these types of brackets such that the bracket can accommodate stabilization and lifting piers of various sizes (1½" to 4" diameter) and configurations (round, square, polyhedron), without sacrificing the structural integrity of any of them. The inventive bracket assembly will also allow the installer to use multiple installation systems (i.e. rotational or direct drive) for erecting the piers. Further the bracket allows for the placement of the various installation tools and components over the direct center of piers to virtually eliminate induced bending moment at the bracket/pier juncture.

The prior art bracket assembly upon which the invention improves is made primarily from standard, structural steel sections and welded steel plates. The primary components of the bracket assembly are a structural bearing angle member, parallel haunch plates, pier guide, load transfer plates, a locking plate, threaded support bolts, and a jacking apparatus. This minimum configuration enables the bracket and pier to be placed directly below a foundation to be lifted. A secondary component, which is used when a pier is offset from the foundation, includes a seating/lifting plate and a temporary jack coupling strap member.

With this type of bracket assembly, the structural bearing angle member supports and lifts the foundation in relation to the pier which is held between the parallel haunch plates. The pier guide provides a supportive stop on the front edge of the pier, and means, such as a pin, are typically provided to engage the rear edge of the pier so that the pier does not fall out from the bracket. The improvement provided by the invention enables an adjustment to be made to the effective space, front to back, within the bracket so that an effective engaging support can be placed on piers of various diameters. Slots 39 are provided at the top of the parallel haunch plots which receive one or more locking tab members which bear against and lock in the pier within the bracket. This eliminates an excess of play of movement of the pier within the bracket which can, undesirably, allow a tremendous bending moment and stress on the pier lifting and supporting the foundation.

Another improvement to the bracket comprises a system to allow the lifting and support means to be aligned with the piers to help eliminate the induced bending moment at the bracket/pier juncture. The load transfer plates, against which the threaded support bolts are drawn, are provided with elongated holes for receiving the bolts. This allows the threaded bolts and locking plate to be moved and aligned with various sized piers placed in the bracket. This feature comes into use in connection with the use of the locking tab members to reduce the effective space, front to back, within the bracket to accommodate smaller diameter piers. Additionally, when the jack coupling strap is employed, the load transfer plate is equipped with a second set of elongated holes to receive the clevis arms of the coupling strap. This, too, allows the jack coupling strap to be moved and aligned with the threaded bolts and the pier upon lifting and supporting of the foundation. To prevent lateral movement of the pier within the bracket, an insert member is placed over the top of the pier. The insert member has a pair of lateral spacer arm members which extend towards the threaded rod members. The rods act as a stop to prevent side-to-side movement of the pier within the bracket.

Through the improvements provided by this invention, these types of foundation supporting brackets enable ready replacement of piers should the need arise. In the event a different configuration or size pier is required after installation of the first pier, due to a change in soil conditions or the like, the locking tab members can be removed to allow the old pier to be withdrawn and exchanged. If the diameter or configuration of the new pier is different from the prior pier, the desired combination of locking tabs can be inserted in the haunch slots 39 as necessary to engage the pier. Likewise, the various lifting hardware can be repositioned in alignment with the new pier by moving the threaded support bolts and jacking straps within the elongated slots of the load transfer plates.

It is therefore an object of the invention to provide a bracket assembly of the type for lifting and supporting a foundation with adjustable lifting and pier positioning hardware, allowing it to transfer foundation loads to piers of varying cross-sectional shapes and sizes. It is a further object of the invention to allow the adjustment, removal and replacement of piers of different configurations as warranted by soil conditions without removing or changing the bracket configuration.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
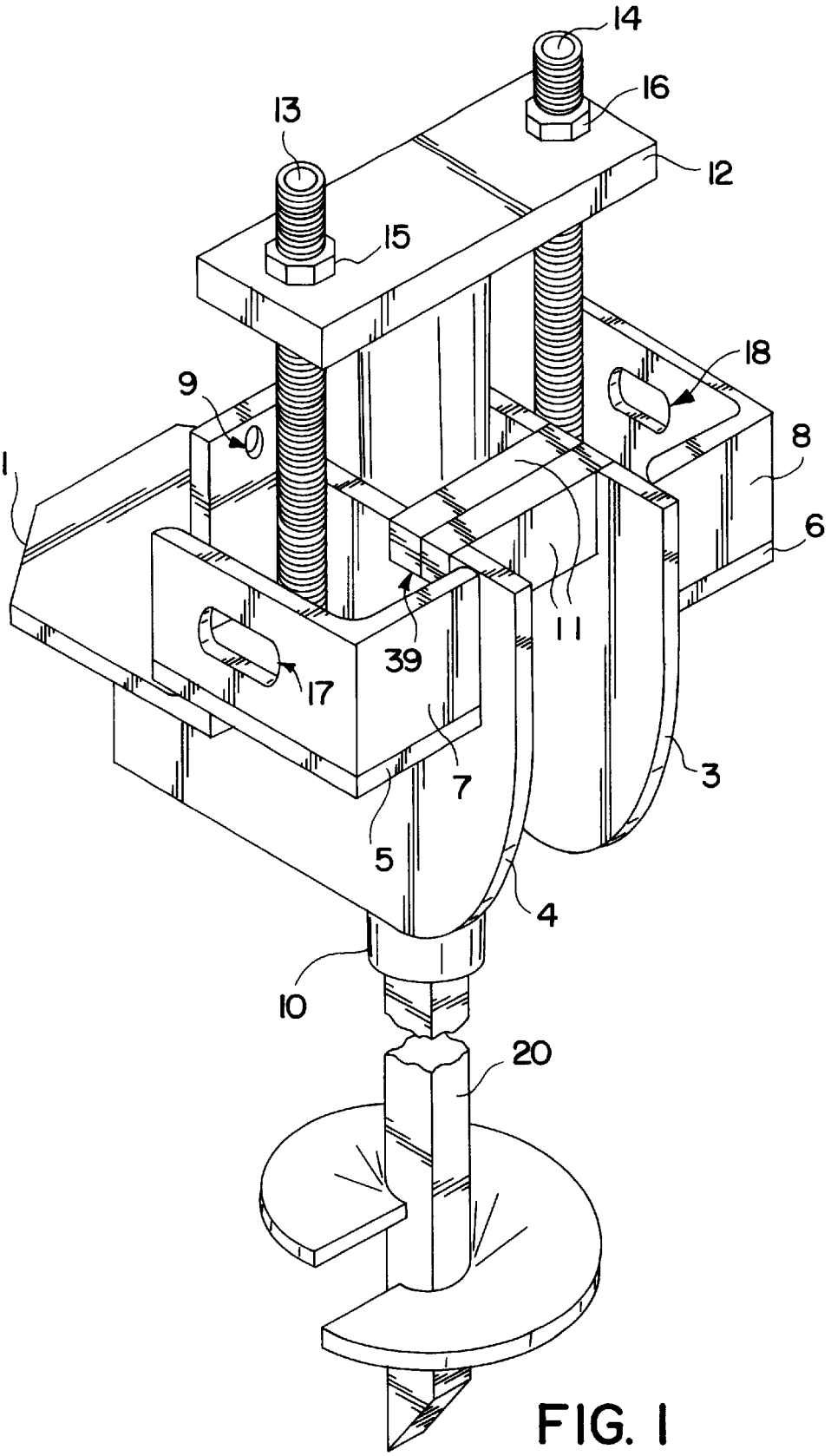
FIG. 1 is perspective view of the invention, shown with a helical steel pile shaft of reduced diameter.
Figure 3:
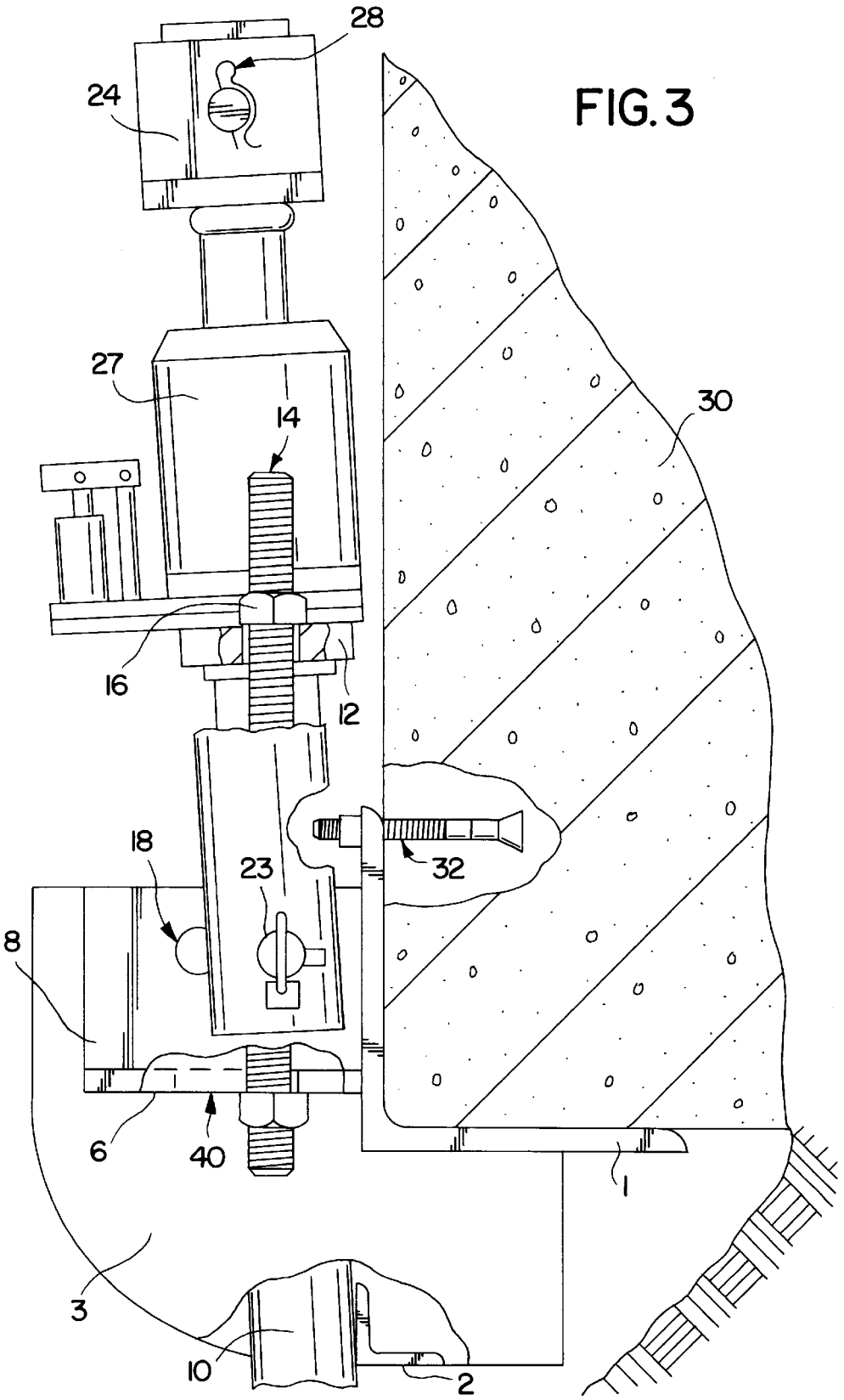
FIG. 3 is a view in side elevation taken from the right side of the bracket assembly, with a pier in place.
Figure 4:
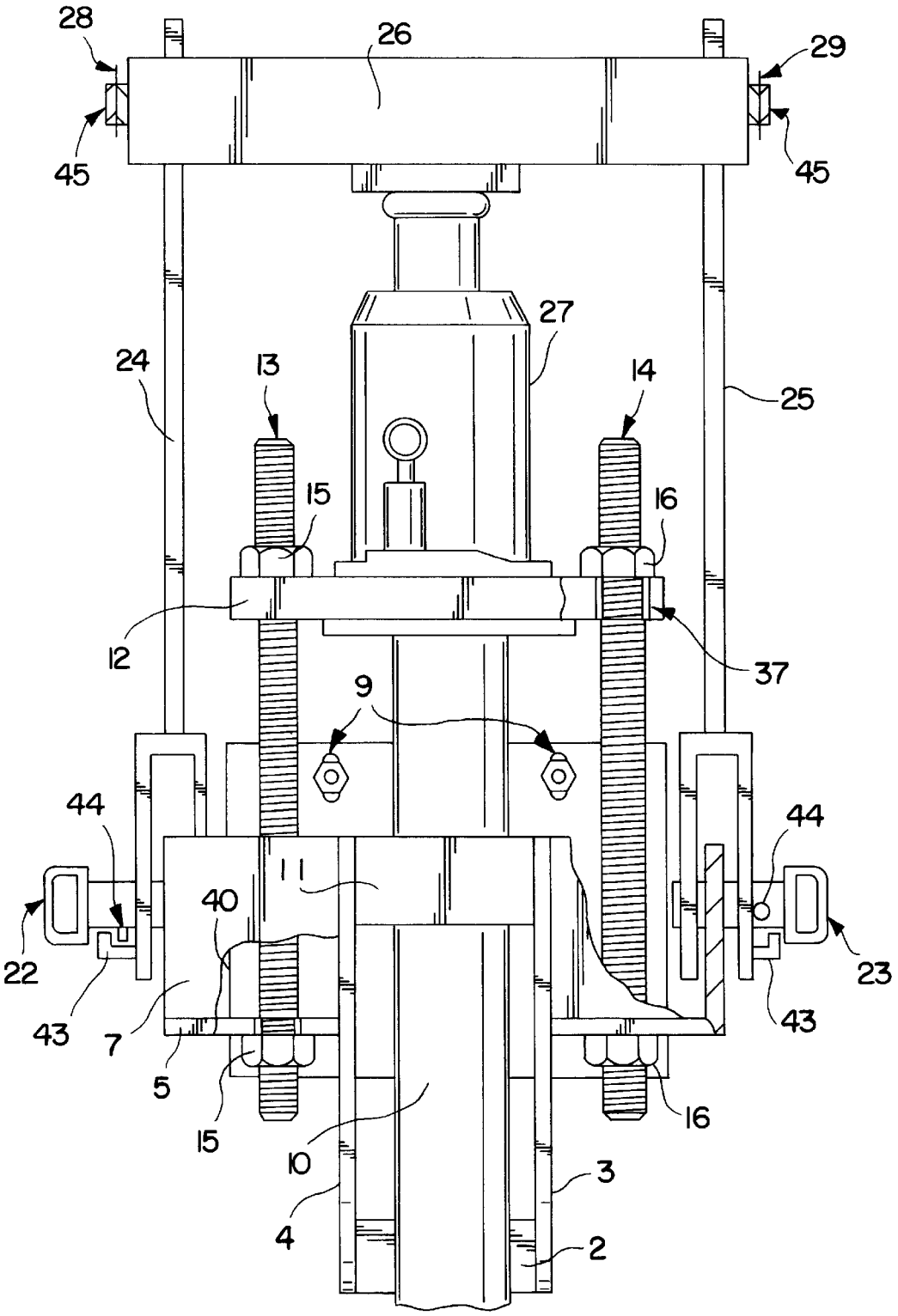
FIG. 4 is a view in side elevation taken from the front of the bracket assembly, with a pier in place.
Figure 5:
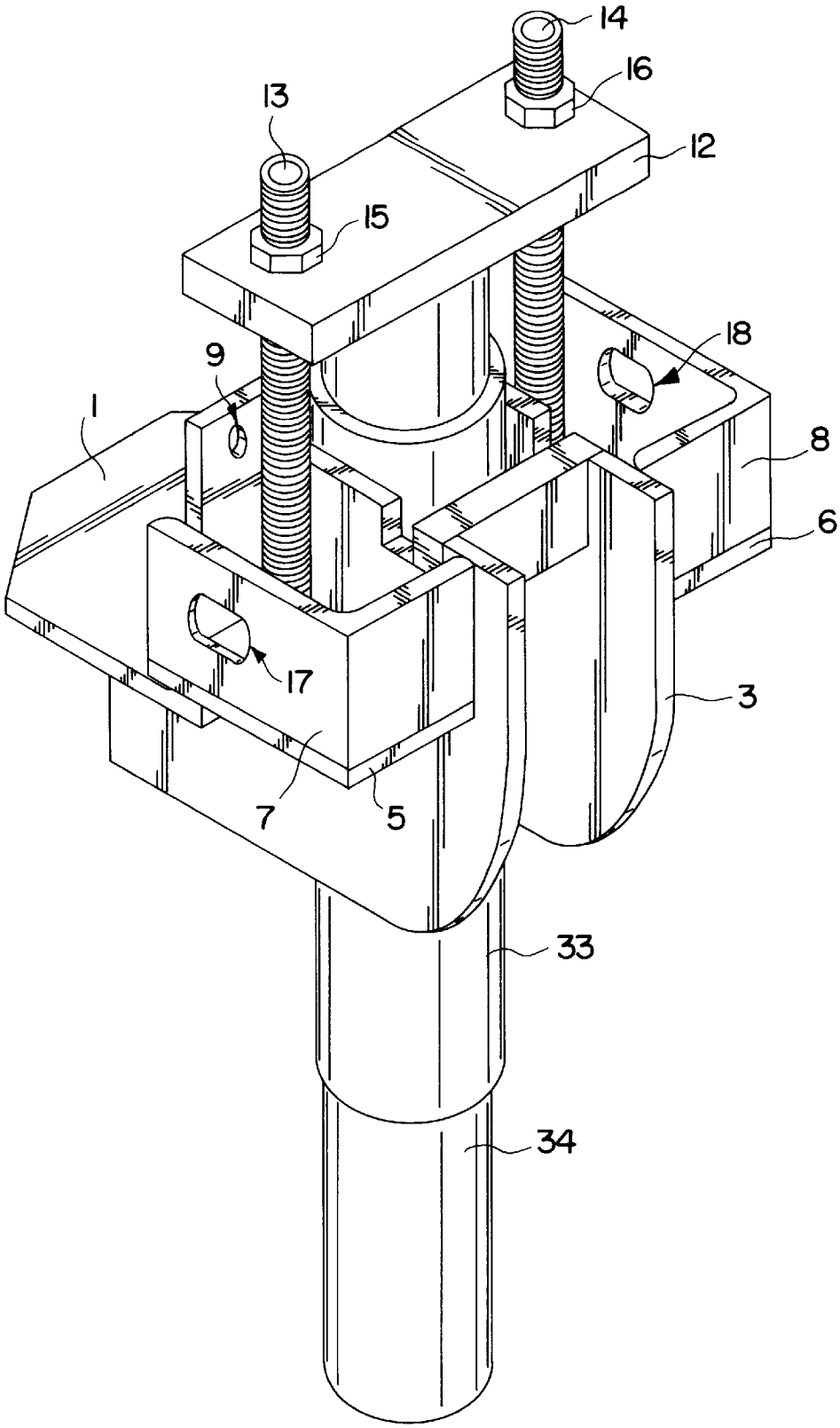
FIG. 5 is perspective view of the invention, shown with a pier of increased diameter.
Figure 8:
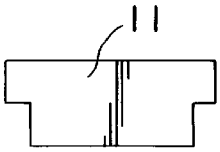
FIG. 8 is a view in side elevation of a pier locking tab member.
Figure 9:
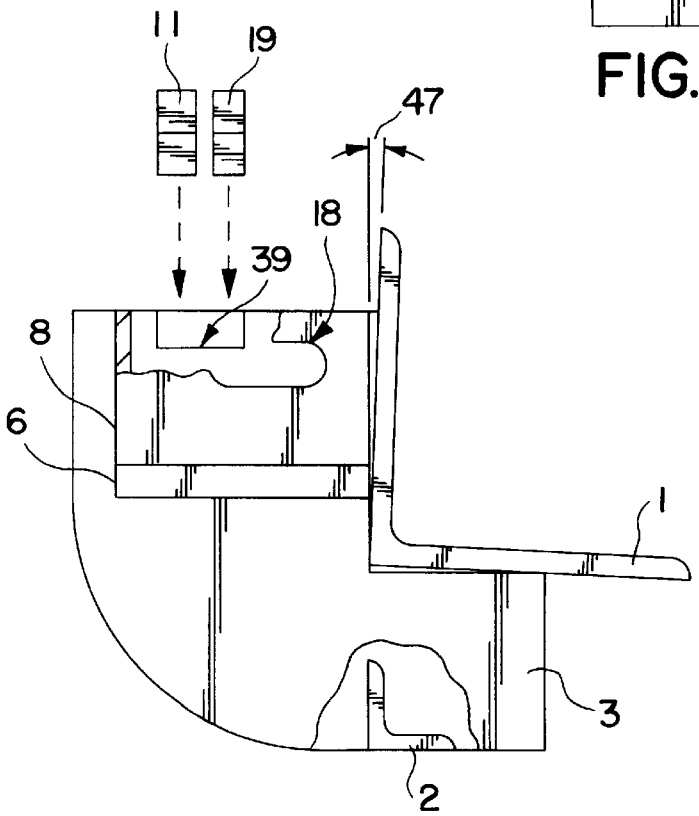
FIG. 9 is a view in side elevation of the bracket assembly, partially broken away.

Referring specifically to FIG. 1, reference numeral 1 refers to the structural bearing angle of a foundation lifting and support bracket assembly to which this invention relates. It is generally L-shaped and is typically cut from standard steel angle and should have a dimension sufficient to support the substantial load of a foundation. It is supplied with two holes 9 drilled or cut in the vertical section of the support angle for the purpose of bolting said angle to the footing or foundation. A pair of haunches 3 and 4 are fabricated from steel plate and are fillet welded to the back of structural bearing angle 1 to help the apparatus resist bending moment induced by the load offset. A pier support 2, as shown in FIG. 3, is welded between plates 3 and 4 to support the front edge of a pier 20 and prevent forward movement of the pier. Rectangular slots 39 are cut in the top of each of haunches 3 and 4, as shown in FIG. 5, to accommodate the insertion of the pier locking tabs 11 and 19 which support and brace the rear edge of pier 20. They keep the top of the pier in engagement with the back of the structural support angle, and prevent rearward movement of the pier between the haunches. The locking tabs have a T-shape, as shown in FIG. 8, so that they can span the distance between the haunches and engage and brace the rear edge of slots 39 to prevent rearward movement. A plurality of locking tabs can be provided to effectively reduce the space, front to back, within the bracket with the addition of each successive locking tab. The thickness of the locking tabs may vary to accommodate different diameter piers. For instance, locking tab 11 may be one inch, and locking tab 19 may be one-half inch. The combination of these varied thickness locking tabs can therefore allow incremental adjustment. Slots 39 and the locking tabs 11 and 19 are positioned at an angle of 2 degrees from vertical, as shown in FIG. 9, to help guide and support piers installed at this same angle. A pier insert member 10 may be placed over pier 20 as shown in FIG. 1. To prevent excessive lateral movement of the pier between haunch plates 3 and 4, a cap plate 50, having lateral spacer arms 52, can be placed on top of, or made integral with, pier insert member 10 and below locking plate 12, as shown in FIG. 4. If pier 20 has a diameter less than the space between haunch plates 3 and 4, the lateral spacer arms will engage threaded support rods 13 and 14 and prevent further sideways movement if the pier should slip to the side. A space of about one-half inch between the ends of the spacer arms and threaded bolts is present to allow moderate lateral movement of the pier, without imparting significant bending or shear stresses on the pier or threaded support bolts.

Figure 7:
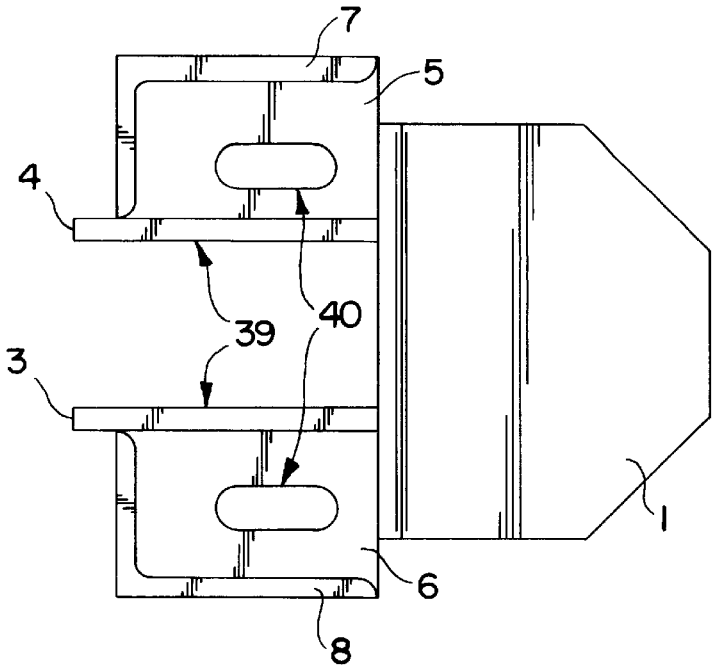
FIG. 7 is a top plan view of the bracket assembly, featuring the load transfer plates.

The primary support components of the bracket comprise locking plate 12, which is disposed over the pier, threaded support bolts 13 and 14, and load transfer plates 5 and 6. Load transfer plates 5 and 6, fabricated from steel plate, are fillet welded to the outside of the haunches 3 and 4. The load transfer plates are furnished with elongated slots 40, as shown in FIGS. 3 and 7, which receive ends of threaded bolts 13 and 14. These bolts are connected with locking plate 12, which together provides the lifting support for the foundation in relation to the pier. Locking plate 12 is furnished with holes that are positioned over slots 40 in load transfer plates 5 and 6. Threaded support rods 13 and 14 protrude through holes in locking plate 12 and slots 40, and are secured in place by heavy hex nuts 15 and 16. In addition to securing the apparatus to the pier by means of the threaded support rods and heavy hex nuts, locking plate 12 serves as a platform for mounting jack 27 during lifting and seating operations. Bolts 13 and 14 are able to be moved along and within slots 40 so that locking plate 12 may be positioned and centered over the pier.

Figure 2:
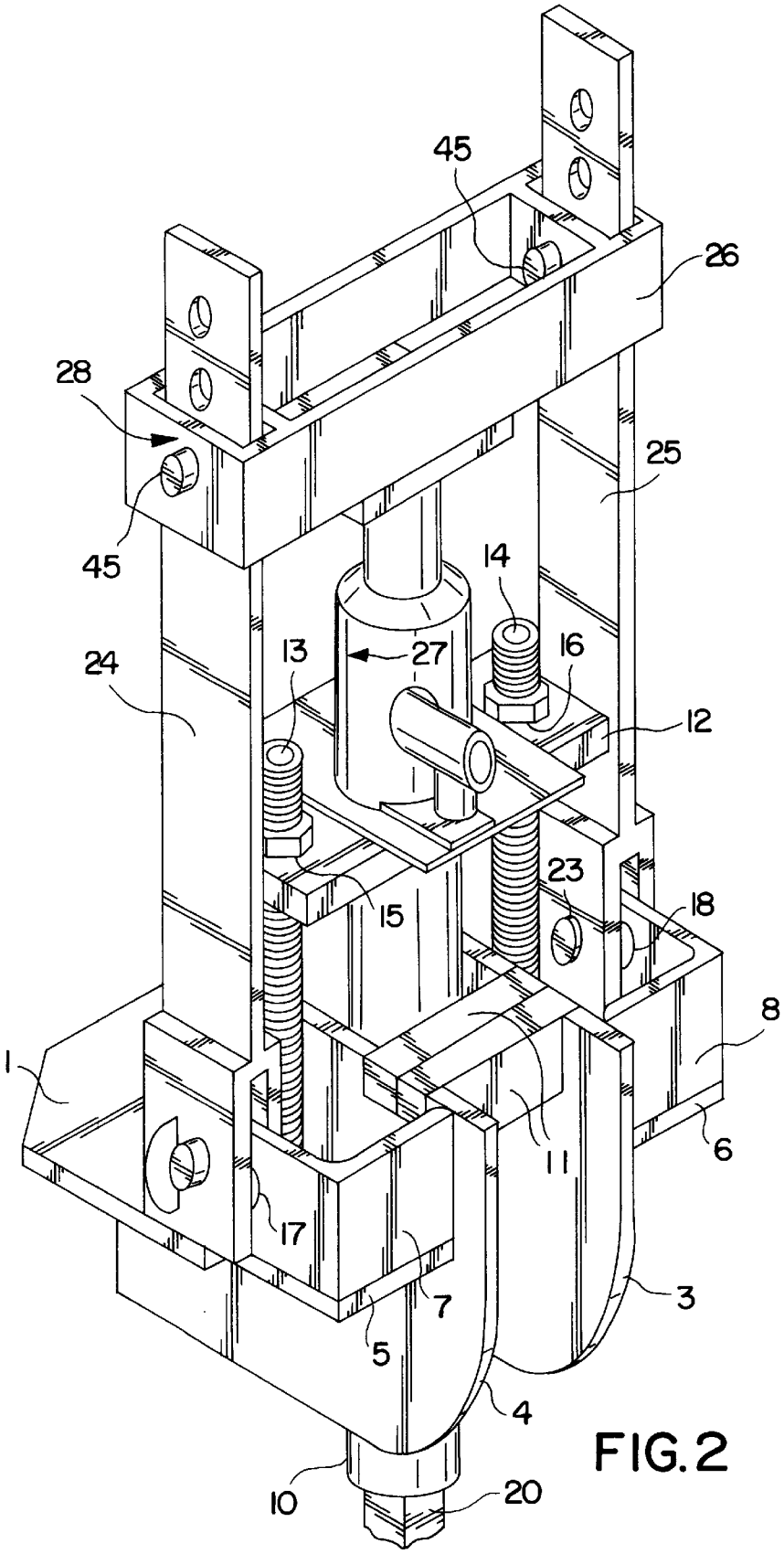
FIG. 2 is perspective view of the invention, similar to FIG. 1, with the jacking system.

The secondary components forming the seating/lifting assembly of the bracket assembly comprise the jack 27, jack coupling straps, and the seating/lifting flanges 7 and 8. The seating/lifting flanges 7 and 8, attached to load transfer plates 5 and 6, respectively, are furnished with elongated slots 17 and 18 for mounting the seating/lifting assembly as shown in FIGS. 1 and 2. They are also welded to the side of the haunches 3 and 4 to provide added, lateral stiffness to the apparatus. The jack coupling straps, as shown in FIGS. 2 and 4, are comprised primarily of two clevis arms 24 and 25, a lifting bar 26, two clevis pins with D-ring pins 22 and 23, and two locking pins 45 for securing the lifting bar to the clevis arms 28 and 29. USE The bracket assembly is first attached to the foundation or footing by drilling said footing or foundation 30 for receiving structural bearing angle 1 using lag bolts 31 and 32 extending through holes 9, as is well known in the art. A pier 20 is driven by a torque motor, or other appropriate means, at a location centered between haunches 3 and 4. The pier is driven until a predetermined torque is reached, at which time the pier is cut off at an elevation 2" to 6" above the top of structural bearing angle 1. The insert 10 is then slid over the top of said pier 20, and positioned toward the back of the structural support angle 1 by means of one or more locking tabs 11. The diameter of the pier will dictate the number of locking tabs used. Generally, piers will increase by one-half inch increments. Thus, a combination of different thickness tabs may be required. With the combination of locking tabs and the lateral spacer arms 52 of cap plate 50 on insert 10, the excess space around the pier within the bracket is minimized. Locking plate 12 is then positioned above the pier and held in place by threaded support rods 13 and 14 and heavy hex nuts 15 and 16 as shown in FIG. 1. Clevis arms 24 and 25 are then attached to the elongated slots 17 and 18 of lifting/seating flanges 7 and 8 by means of D-ring pins 22 and 23, as shown in FIG. 2. Lifting bar 26 is then attached to clevis arms 24 and 25 by locking pins 28 and 29. Lifting jack 27 is then placed on top of locking plate 12 and centered beneath lifting bar 26. As lifting jack 27 is energized, the apparatus, with the exception of locking plate 12 and lifting jack 27, will move upward with reference to pier 20 and insert 10. The elongated holes 40 in the load transfer plates 5 and 6 allow the locking plate 12 to adjust in the horizontal plane such that it and the lifting jack can be positioned concentrically above the piers. Likewise the elongated slots 17 and 18 in the seating/lifting flanges 7 and 8 allow the entire lifting assembly to move in the horizontal plane with the lifting jack and locking plate 12 for central positioning. These two adjustment features are what keep the transferred load from putting undue stress on a piering system, in that they help decrease the distance between the pier and the foundation within the bracket. Accordingly, bending moment on the pier is decreased.

After structural bearing angle 1 is properly seated or until a predetermined lift has been achieved, heavy hex nuts 15 and 16 are tightened. The tightening of hex nuts 15 and 16 on threaded support rods 13 and 14 secures the lift that was achieved by lifting jack 27 and the lifting assembly. It should be noted that any flexing induced into the apparatus by lifting or seating will serve to secure the pier locking tabs 11 in place. After heavy hex nuts 15 and 16 have been tightened, lifting jack 27 can be de-energized and removed, along with the entire lifting assembly.

Figure 6:
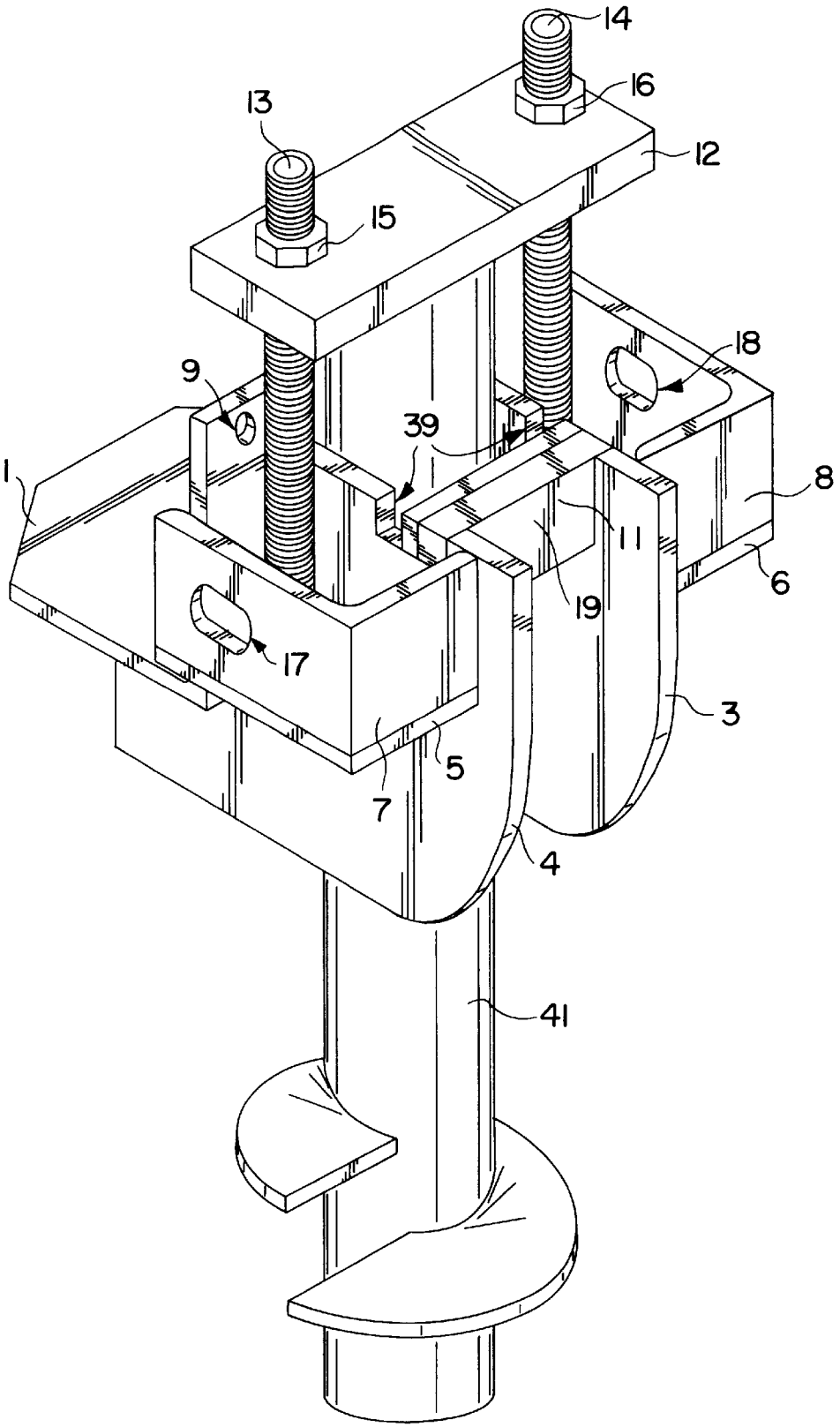
FIG. 6 is perspective view of the invention, shown with a pier of intermediate diameter.

When the apparatus is used in conjunction with a larger diameter pier, such as a 3½" hollow shaft helical pile 41 as shown in FIG. 6, the operation is the same as outlined above, except no insert member 10 is required. The diameter of the pier itself will be sufficient to engage, and be retained by, haunches 3 and 4. The locking plate 12 is centered over the pier 41 by sliding the threaded support rods 13 and 14 horizontally in the elongated slots 40 located in the load transfer plates 5 and 6. The lifting bar 26 is centered over the pier 41 by sliding clevis arms 24 and 25 in elongated slots 17 and 18. Additionally, only one of the thinner locking tabs 19 is needed to draw the pier 41 to the back of structural bearing angle 1. When the apparatus is used in conjunction with a pipe pier 34, as shown in FIG. 5, the operation is much the same as outlined above. A guide sleeve 33 is used in lieu of insert 10, and all centering of lifting arm 26 and locking plate 12 is accomplished by means of adjustments made in the elongated slots 40, and 17 and 18, respectively.

The improvement to foundation lifting and support brackets as contemplated by this invention may also be used when the pier is placed directly below the foundation. With that type of bracket, the jacking apparatus is not offset from the bracket, but rather, is aligned with the foundation and the bracket as is well known in the art. However, if the pier is not aligned with the jacking apparatus and centered directly under the foundation at the point of lifting force, an excessive bending moment can be placed on the pier. Therefore, the principles of the invention allow for the adaptability of this type of bracket for different size piers. The locking tabs and elongated slots are utilized as needed to center the pier and lifting and support apparatus as needed.

A major advantage of the improvement to the lifting and support bracket is the ability to remove an installed pier if desired. If the determination is made in the field that conditions favor one pier configuration over another, the substitution can be made in a timely and efficient manner. In that the locking tabs are themselves removable, a previously installed pier may be backed out and removed in the field, without removal of the bracket from the foundation or footing. Upon installation of a new pier, the locking tabs are reinserted. If the diameter of the newly installed pier is different from the previous pier, one simply adds or deletes the appropriate number of locking tabs to securely engage the pier within the bracket.

Various changes and modifications may be made within this invention as will be apparent to those skilled in the art. Such changes and modifications are within the scope and teaching of this invention as defined in the claims appended hereto.

What is claimed is:

1. An apparatus for lifting and supporting a foundation, said apparatus comprising a bracket assembly, said bracket assembly comprising:

means for engaging said foundation;

means for receiving a pier; and means for lifting and supporting said foundation relative to said pier;

wherein the improvement comprises said bracket assembly being adjustable to receive varying widths and configurations of piers, said means of said bracket assembly for receiving said pier having an adjustable brace member for engagement with said pier to reduce bending moment on said pier within said bracket assembly caused by said lifting and supporting of said foundation.

2. The apparatus of claim 1 in which said means of said bracket assembly for receiving said pier comprises a pair of parallel spaced apart plates between which said pier is received, said means for engaging said foundation comprises an L-shaped plate member, said parallel plates being connected at ends thereof to said L-shaped plate member, said adjustable brace member being disposed at opposite ends of said parallel plates, said pier being disposed between and engaged by said L-shaped member and said adjustable brace member.

3. The apparatus of claim 2 in which said adjustable brace member comprises at least one pier locking tab member, a slot being disposed along a top edge of each of said parallel plates, said slots being in alignment with each other, said pier locking tab member having a length spanning said parallel plates and being adapted to be received within said slots for retaining said pier.

4. The apparatus of claim 3 in which a plurality of pier locking tab members are receivable side-by-side within said slots whereby piers of various size may be removably retained.

5. The apparatus of claim 4 in which said pier locking members are of varied thicknesses.

6. The apparatus of claim 2 in which said means for lifting and supporting said foundation comprises:

a locking plate member horizontally disposed over, and in effective contact with, said pier, threaded rod members, and load transfer plate members, one each of said load transfer plate members being horizontally disposed at an outer edge of each of said parallel plates, said locking plate member having apertures at ends thereof for alignment with openings disposed in said load transfer plates to receive said threaded rod members, wherein the improvement comprises said openings in said load transfer plate members being elongated, said rod members being capable of being moved within said elongated openings for alignment with said pier to reduce bending moment on said pier and said threaded rod members upon lifting and supporting of said foundation.

7. The apparatus of claim 6 in which said adjustable brace member comprises at least one pier locking tab member, a slot being disposed along a top edge of each of said parallel plates, said slots being in alignment with each other, said pier locking tab member having a length spanning said parallel plates and being adapted to be received within said slots for retaining said pier.

8. The apparatus of claim 7 in which a plurality of pier locking tab members are receivable side-by-side within said slots whereby piers of various size may be removably retained.

9. The apparatus of claim 6 in which a cap plate member is positioned over a top of said pier, said cap plate member being engageable with said locking plate member, said cap plate member having a pair of lateral spacer arm members which extend towards said threaded rod members, said threaded rod members acting to stop said spacer arm members to reduce lateral movement of said pier upon lifting and supporting of said foundation.

10. The apparatus of claim 7 in which said adjustable brace member comprises at least one pier locking tab member, a slot being disposed along a top edge of each of said parallel plates, said slots being in alignment with each other, said pier locking tab member having a length spanning said parallel plates and being adapted to be received within said slots for retaining said pier.

11. The apparatus of claim 10 in which a plurality of pier locking tab members are receivable side-by-side within said slots whereby piers of various size may be removably retained.

12. The apparatus of claim 6 in which said means for lifting and supporting said foundation further comprises:

a jacking means supported on said locking plate, a lifting bar member, and a pair of clevis arm members, said lifting bar member being disposed over, and in engagement with, said jacking means, said clevis arms depending from said lifting bar member and being engageable with said load transfer plate members, said load transfer plate members each having a vertically disposed planar portion with an opening therein for receiving an end of each respective clevis arm, whereby said jacking means can be actuated so that said foundation can be further lifted and supported relative to said pier, wherein the improvement comprises said openings in said vertically disposed planar portion of said load transfer plate members being horizontally elongated, said clevis arm ends being capable of being moved along said elongated openings for alignment with said pier to reduce bending moment on said pier upon lifting and supporting of said foundation.

13. The apparatus of claim 3 in which rear internal edges of said slots have a 2 degree inclination away from vertical with respect to said L-shaped plate member such that a face of said pier locking tab member has a 2 degree inclination away from said L-shaped member.

14. The apparatus of claim 13 in which a support guide angle member is provided between said parallel plates to support an inside surface of said pier, said support guide angle member having a similar two degree inclination as said slots, whereby said support guide angle member and said slots approximate a directional orientation of said pier with respect to said foundation to be lifted.

15. The apparatus of claim 8 in which said adjustable brace member comprises at least one pier locking tab member, a slot being disposed along a top edge of each of said parallel plates, said slots being in alignment with each other, said pier locking tab member having a length spanning said parallel plates and being adapted to be received within said slots for retaining said pier.

16. The apparatus of claim 15 in which a cap plate member is positioned over a top of said pier, said cap plate member being engageable with said locking plate member, said cap plate member having a pair of lateral spacer arm members which extend towards said threaded rod members, said threaded rod members acting to stop said spacer arm members to reduce lateral movement of said pier upon lifting and supporting of said foundation.

* * * * *